US011359421B2

(12) United States Patent
Runge et al.

(10) Patent No.: US 11,359,421 B2
(45) Date of Patent: Jun. 14, 2022

(54) COMPRESSION LATCH WITH SECURING DEVICE

(71) Applicant: EMKA Beschlagteile GMBH & Co. KG, Velbert (DE)

(72) Inventors: Friedhelm Runge, Wuppertal (DE); Michael Backhaus, Dortmund (DE)

(73) Assignee: EMKA BESCHLAGTEILE GMBH & Co KG, Velbert (DE)

( * ) Notice: Subject to any disclaimer, the term of this patent is extended or adjusted under 35 U.S.C. 154(b) by 524 days.

(21) Appl. No.: 16/334,281

(22) PCT Filed: Sep. 20, 2016

(86) PCT No.: PCT/EP2016/072279

§ 371 (c)(1),
(2) Date: Mar. 18, 2019

(87) PCT Pub. No.: WO2018/054450

PCT Pub. Date: Mar. 29, 2018

(65) Prior Publication Data

US 2019/0234124 A1 Aug. 1, 2019

(51) Int. Cl.
*E05C 3/04* (2006.01)
*E05B 35/00* (2006.01)
(Continued)

(52) U.S. Cl.
CPC ..... *E05C 3/042* (2013.01); *E05B 17/0025* (2013.01); *E05B 35/008* (2013.01); *E05C 5/02* (2013.01)

(58) Field of Classification Search
CPC ... E05C 3/042; E05C 5/02; E05C 3/00; E05C 3/002; E05C 3/004; E05C 3/02;
(Continued)

(56) References Cited

U.S. PATENT DOCUMENTS 7,452,010 B2 * 11/2008 Cotton ..... E05B 1/0092 292/100
9,416,569 B1 8/2016 Leone et al.
(Continued)

FOREIGN PATENT DOCUMENTS

CN 101946054 A 2/2009
CN 202559908 U 4/2012
(Continued)

OTHER PUBLICATIONS

International Search Report PCT-EP2016/072279 (2 pages).

*Primary Examiner* — Christine M Mills
*Assistant Examiner* — Yahya Sidky

(57) ABSTRACT

A compression latch includes a cylindrical housing (1). A locking shaft (2) is rotatably and axially movable in the housing. The locking shaft includes an axial free end (14) that engages a locking element (12). A cylindrical sleeve (3) engages an axial end of the locking shaft opposed of the free end. The sleeve includes an axially tapered annular sleeve slot (19) in which a shaft engagement pin (7) is engaged to cause axial movement of the locking shaft with rotational movement sleeve until the pin engages a slot end. After pin engagement with the slot end, further rotation of the sleeve causes rotation of the locking shaft. A cylindrical securing element (4) is rotatably engaged with and is axially movable relative to the sleeve. The securing element includes a circumferentially extending guiding recess (17) and a transversely extending latching recess (18). A securing element engaging pin (9) is engageable with the latching recess to prevent rotational movement of the securing element and the sleeve until the securing element is moved axially inwardly to disengage the pin and the latching recess.

20 Claims, 1 Drawing Sheet

(51) Int. Cl.
*E05C 5/02* (2006.01)
*E05B 17/00* (2006.01)

(58) Field of Classification Search
CPC ... E05C 3/04; E05C 3/041; E05C 3/06; E05B 17/0025; E05B 35/008; E05B 5/00; E05B 17/04; E05B 33/00; E05B 65/006; Y10T 292/0911; Y10T 292/0945; Y10T 292/0947; Y10T 292/0949; Y10T 292/0951; Y10T 292/0863; Y10T 292/0864; Y10T 292/0886; Y10T 292/0887; Y10T 292/0889; Y10T 292/089; Y10T 292/0891; Y10T 292/1043; Y10T 292/1075; Y10T 292/1077; Y10T 292/108; Y10T 292/1083; Y10T 292/1092; Y10T 292/0959; Y10T 292/1097; Y10T 292/1098; Y10T 292/20; Y10T 292/202; Y10T 292/225; Y10T 70/7836; Y10T 70/7842; Y10T 70/7853; Y10T 70/787; Y10T 70/5363; Y10T 70/7757; Y10T 70/7763; Y10T 70/542; Y10T 70/5425; Y10T 70/5429; Y10T 70/5434; Y10T 70/5438; Y10T 70/5442; Y10T 70/5447; Y10T 70/5451; Y10T 70/5465; Y10T 70/5469; Y10T 70/5473; Y10S 292/11; Y10S 292/27
See application file for complete search history.

(56) References Cited

U.S. PATENT DOCUMENTS

| | | | | |
|---|---|---|---|---|
| 2002/0166353 | A1* | 11/2002 | Vickers | E05C 5/00 70/127 |
| 2005/0115288 | A1* | 6/2005 | Burmahln | E05B 17/0025 70/127 |
| 2014/0353983 | A1* | 12/2014 | Vetter | E05C 3/042 292/197 |

FOREIGN PATENT DOCUMENTS

| | | | |
|---|---|---|---|
| CN | 202954642 | U | 11/2012 |
| DE | 29820711 | U1 | 3/2000 |
| DE | 20019247 | U1 | 1/2001 |
| DE | 202004005030 | U1 | 3/2004 |
| DE | 202005005774 | U1 | 6/2005 |
| DE | 202010012699 | U1 | 12/2010 |
| DE | 202013104526 | U1 | 12/2013 |
| DE | 202014100045 | * | 12/2013 |
| DE | 202013104526 | * | 6/2014 |
| EP | 1411198 | A1 | 4/2004 |
| EP | 2628875 | A1 | 8/2013 |
| WO | WO 2009/103414 | A1 | 2/2009 |

* cited by examiner

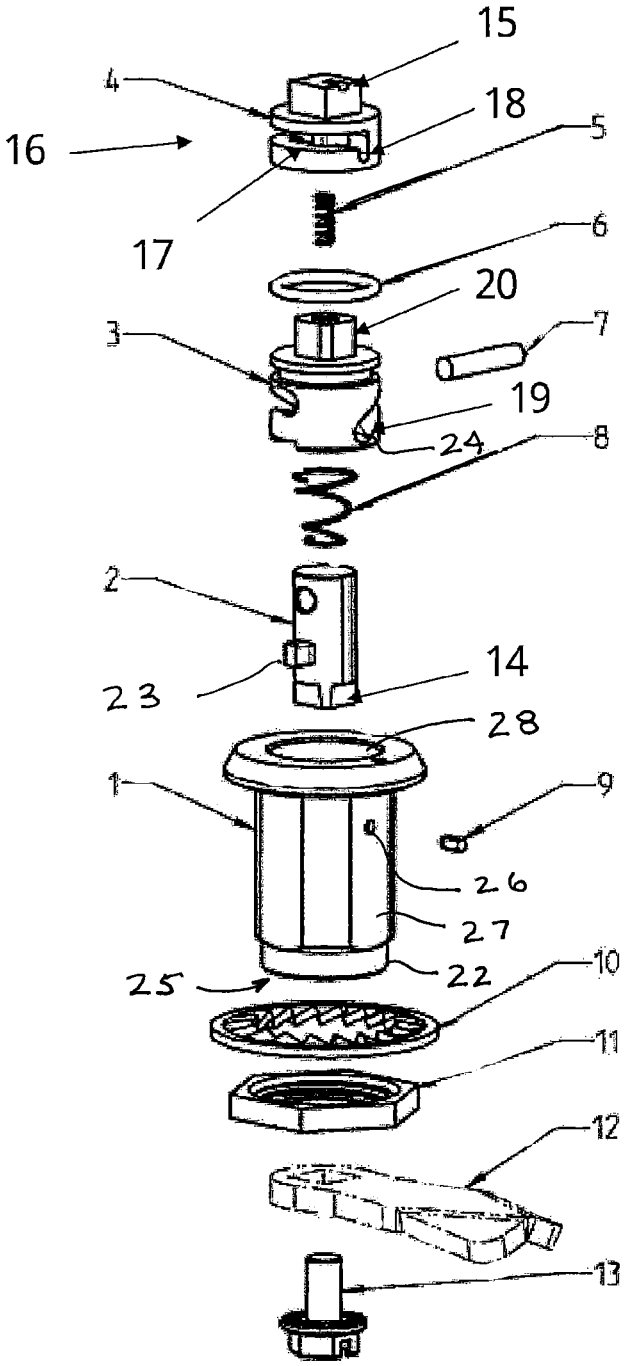
15
4
18
16
5
17
6
20
3
7
19
24
8
2
14
23
28
1
9
26
27
25
22
10
11
12
13

COMPRESSION LATCH WITH SECURING DEVICE

TECHNICAL FIELD

The exemplary arrangement relates to a compression latch with a locking housing, with a locking shaft, wherein a locking element can be attached to a free end of the locking shaft, which projects over the locking housing, and with an actuating projection, which is arranged in the locking housing and which can be made to perform a rotational movement by means of a tool, wherein the actuating projection and the locking shaft are coupled to each other during the rotational movement of the actuating projection from a locking position into an opening position in such a way that the locking shaft performs a linear movement in the axial direction out of the locking housing and also a rotational movement.

BACKGROUND

The locking housing of the compression latch is fitted in an aperture formed in a door or hatch. During the locking procedure the locking element, in particular designed in the form of a locking tongue, is turned behind a frame supporting the door and the locking element is moved axially in the direction of the frame as a result of the subsequent linear movement of the locking shaft. Through this the door is locked to the frame in a pre-tensioned manner. A compression latch of this type is known from DE 20 2013 104 526 U1 for example.

Due to the locking element being applied to the frame in a pre-tensioned manner the compression latch is secured in its locking position against unintentional loosening through vibrations. However, a desire has now arisen to secure the compression latch with additional means against unintentional opening caused by vibrations.

SUMMARY

The aim of an exemplary arrangement is to design a compression latch in such a way that it is secured in redundant manner against an opening movement caused by vibrations.

This task is solved by a compression latch having the features of the independent claims. Advantageous further developments are set out in the dependent claims and in the detailed description, wherein individual technical feature of the advantageous further developments can be combined with each other in any technologically rational way.

The task is solved in particular through a compression latch with the features cited in the introduction, which comprises a securing device that in the locking position secures the actuating projection against turning and has a securing element, which is pushed axially into the locking housing against spring loading by the tool for releasing the actuating projection, so that with the securing element being pushed into the locking housing the actuating projection can be rotated.

Through the securing device it is thus prevented that the actuating projection is made to perform a rotational movement coupled with the linear and rotary movement of the locking shaft for as long as the securing element of the securing device is not actuated by the tool.

Through this additional means it is thus prevented that the compression latch can be moved from its locking position into its opening position solely by vibrations.

The functional principle of a compression latch is known from DE 20 2013 104 526 U1 mentioned in the introduction and the prior art cited therein.

In particular, the locking element is designed as a locking tongue, which is screwed into the free end of the locking shaft. However, the locking element could also be formed in one piece with the locking shaft.

Accordingly, it is meant that the securing element, which can be pushed axially into the locking housing, can be displaced by the tool in the direction of the locking shaft. It is not necessary for the securing element to be arranged outside the locking element before being displaced.

In particular, during the axial linear movement only sections of the locking shaft are moved out of the locking housing.

The actuating projection is that element, to which the tool is applied to initiate the rotational movement.

In one embodiment the securing element comprises a guide slot, which has a guiding recess running in the circumferential direction and which has on at least one end of the guiding recess a latching recess extending in the axial direction, wherein the securing device also comprises a pin, which engages in the guide slot and which engages in the latching recess in the locking position and which moves out of the latching recess through the displacement of the securing element in the axial direction and which is guided in the guiding recess during the rotational movement of the actuating projection. The guide slot and the pin are thus arranged on the compression latch in such a way that they can be moved relative to each other. In principle it is conceivable that the guide slot is arranged directly in the locking housing or in an element connected to the locking housing in a torque-resistant manner. In this case the pin would be connected to the securing element of the securing device, so that during the opening and locking procedure the pin is moved relative to the stationary guide slot. Alternatively the pin could be connected to the locking housing in stationary manner, wherein the guide slot is arranged on an element in such a way that it can be moved relative to the pin fastened on the locking housing.

In the exemplary arrangement the guide slot is formed on the securing element. The guide slot is thus formed on the component, which can be axially pushed by the tool into the locking housing.

In particular, in this connection it is envisaged that the pin is attached in the locking housing and engages in the guide slot in the interior of the locking housing. More particularly, the pin can be pushed into the locking housing from outside laterally so that it protrudes into the interior of the housing. In this way the pin can be mounted after the securing element has been arranged in the locking housing.

In order to reduce the number of components it can be envisaged that the securing element is formed in one piece with the actuating projection.

Alternatively it can be envisaged that the securing element is arranged in a torque-resistant and linearly displaceable manner in relation to the actuating projection. On insertion of the tool into the compression latch the securing element is thus displaced relative to the locking housing and relative to the actuating projection, wherein a rotational movement of the actuating projection connected to the securing element in a torque-resistant manner is only possible after the securing element has been pushed in.

To couple the actuating projection to the locking shaft a second guide slot and a second pin are provided, of which either the second guide slot or the second pin is non-rotatably connected to the actuating projection and the other element is non-rotatably connected to the locking shaft. The guide slot is configured in such a way that during a rotational movement of the actuating projection in order to move the compression latch from the locking position into the opening position the pin is initially movable in the axial direction. Furthermore, either the guide slot is designed and/or a stop is arranged in such a way that during the further rotational movement of the actuating projection the locking shaft is turned with the rotational movement of the actuating projection.

In particular, it is envisaged that a rotatable, axially fixed rotary clamping sleeve is arranged in the locking housing, which is coupled in torque-resistant manner to the actuating projection and which has the second guide slot, wherein the second pin passes through the locking shaft and engages in the second guide slot, so that on rotation of the rotary clamping sleeve the locking shaft can be axially displaced.

If the securing element is formed in one piece with the actuating projection and, in particular, the guide slot is formed on the securing element, in this context it can be envisaged that the actuating projection is arranged in torque-resistant manner in relation to a projection of the rotary clamping sleeve, wherein the actuating projection is linearly displaceable against a spring arranged between the actuating projection and the rotary clamping sleeve. More particularly, the spring is arranged in a blind hole in the projection of the rotary clamping sleeve and pre-stresses the actuating projection.

Alternatively it can be envisaged that the actuating projection is formed in one piece on the rotary clamping sleeve, wherein in this case the securing element, in particular having the guide slot, is arranged in a linearly displaceable, but torque-resistant manner with regard to the actuating projection.

BRIEF DESCRIPTION OF DRAWING

The exemplary embodiment will be described below with the aid of the drawing FIGURE.

FIG. 1 shows an exploded view of a compression latch.

DETAILED DESCRIPTION

The exemplary compression latch comprises a locking housing 1, which is alternatively referred to herein as a cylindrical housing, arranged in which an actuating projection 15 for a tool and a rotary clamping sleeve 3 connected to the actuating projection 15 in torque-resistant manner. Clamping sleeve 3 is alternatively referred to herein as a cylindrical sleeve. By way of a nut 11 arranged on the rear side of the door, an inner axial end 22 of the axially elongated locking housing 1 can be fastened in an aperture of a door. A washer 10 can also be arranged on the rear side of the door.

The actuating projection 15 is operatively connected to the rotary clamping sleeve 3 via a protrusion 20 on the rotary clamping sleeve 3. Protrusion 20 is alternatively referred to herein as an axially extending sleeve projection. An O- ring 6 seals the rotary clamping sleeve 3 with regard to the locking housing 1. The rotary clamping sleeve 3 has a second guide slot 19, in which a second pin 7 engages. Guide slot 19 is alternatively referred to herein as an axially tapered annular sleeve slot. Pin 7 is alternatively referred to herein as a shaft engagement pin. The second pin 7 is in engagement with and passes through the locking shaft 2, which is pre-tensioned with regard to the rotary clamping sleeve 3 by means of a second spring 8. The spring 8 is engaged with a first axial end of the locking shaft. At a free axial end 14 of the locking shaft 2, which is alternatively referred to as a second axial end of the locking shaft, a locking element in the form of a locking tongue 12 can be fastened in a known manner with a screw 13.

In the case of an opening movement initiated by turning the actuating projection 15, due to the connection of the locking shaft 2 to the rotary clamping sleeve 3 a rotational movement of the rotary clamping sleeve 3 is initially converted into an axial movement of locking shaft 2, during which the outward extending projection 23 on the locking shaft 2 is in contact with a stop (not shown) in the locking housing 1 and during which the second guide slot 19 moves relative to the second pin 7. On further turning of the actuating projection 15 a rotational movement of the locking shaft 2 then takes place, during which the second pin 7 is in contact with an end 24 of the second guide slot 19. End 24 is alternatively referred to herein as a slot end. The functioning and interaction of the rotary clamping sleeve 3 and the locking shaft 2 are described in DE 20 2013 104 526 UI cited in the preamble which incorporated herein by reference in its entirety.

In a locking position the locking shaft 2 is thus pulled into the locking housing 1. During opening the locking shaft 2 is initially linearly moved out from an opening 25 at the inner axial end 22 of the locking housing 1, wherein a rotational movement then takes place so that the door locking is released.

In order to prevent unintentional opening of the compression latch through vibrations, the example arrangement envisages the creation of a securing device. The securing device comprises a securing element 4 which in the form of embodiment shown in the Figure is produced in one piece with the actuating projection 15. The securing element 4 has a guide slot 16 which has a circumferentially extending guiding recess 17 running in the circumferential direction and a latching recess 18 extending in the axial direction transversely to the guiding recess and toward the inner axial end 22 of the housing. The securing device also has a pin 9 which can be inserted in an opening 26 that extends from an outside surface 27 into the locking housing 1 and protrudes into the interior of the locking housing 1, where the pin 9 engages in the guide slot 16. The actuating projection 15 comprising the securing element 4 is also pre-tensioned vis-á-vis the rotary clamping sleeve 3 by means of a spring 5. The securing element 4 is alternatively referred to herein as a cylindrical securing element. The pin 9 is alternatively referred to herein as a securing element engaging pin.

In a locking position the pin 9 engages in the latching recess 18 as a result of which the actuating projection 15 is secured against a rotational movement. To release this securing, the exemplary actuating projection 15 comprising the securing element 4 has to be pushed axially into the outer axial end opening 28 of the locking housing 1, through which the pin 9 moves out of the latching recess 18. In the following the actuating projection 15 can be turned with regard to the locking housing 1, wherein the pin 9 is guided in the guiding recess 17. The rotational movement of the actuating projection 15 initiating opening can thus only be carried out, if the securing element 4 has been pushed into the locking housing 1, so that unintentional opening through vibrations alone is prevented.

Thus the exemplary embodiments achieve improved operation, eliminate difficulties encountered in the use of prior devices and systems and attain the useful results described herein.

In the foregoing description, certain terms have been for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the features shown and described.

Having described the features, discoveries and principles of the exemplary embodiments, the manner in which they are constructed and operated, and the advantages and useful results attained, the new and useful features, devices, elements, arrangements, parts, combinations, systems, equipment, operations, methods, processes and relationships are set forth in the appended claims.

LIST OF REFERENCE NUMBERS

1 Locking housing
2 Locking shaft
3 Rotary clamping sleeve
4 Securing element
5 Spring
6 O-ring
7 Second pin
8 Second spring
9 Pin
10 Washer
11 Nut
12 Locking tongue
13 Screw
14 Free end
15 Actuating projection
16 Guide slot
17 Guiding recess
18 Latching recess
19 Second guide slot
20 Projection
22 Inner axial end
23 Projection
24 Slot end
25 Opening
26 Opening
27 Outside surface
28 End opening

The invention claimed is:

1. Apparatus comprising:

a compression latch including a locking housing, with a locking shaft, wherein the locking shaft is configured to enable a locking element to be attached to a free end of the locking shaft, which projects over the locking housing, and with an actuating projection, which is arranged in the locking housing and which actuating projection is enabled to be made to perform a rotational movement by means of a tool, wherein the actuating projection and the locking shaft are coupled to each other during the rotational movement of the actuating projection from a locking position into an opening position in such a way that the locking shaft performs a linear movement in an axial direction out of the locking housing and also a rotational movement, characterized in that the compression latch comprises a securing device, which secures the actuating projection when in the locking position against rotation toward the opening position and which has a securing element, wherein the securing element is configured to can be pushed axially into the locking housing against spring loading by the tool to release the actuating projection from being rotationally fixed, so that with the securing element being pushed into the locking housing the actuating projection is enabled to be rotated from the locking position to the opening position.

2. The apparatus according to claim 1, wherein the securing device comprises a guide slot, which has a guiding recess running in a circumferential direction and which has on at least one end of the guiding recess a latching recess extending from the guiding recess in the axial direction, wherein the securing device also comprises a pin which engages in the guide slot and which in the locking position engages in the latching recess and which moves out of the latching recess through a displacement of the securing element in the axial direction and which is guided in the guiding recess during the rotational movement of the actuating projection.

3. The apparatus according to claim 2, wherein the guide slot is formed on the securing element.

4. The apparatus according to claim 3, wherein the pin is fastened in the locking housing, and engages in the guide slot in an interior of the locking housing.

5. The apparatus according to claim 1, wherein the securing element is formed in one piece with the actuating projection.

6. The apparatus according to claim 1, wherein the securing element is arranged in a torque-resistant and linearly displaceable manner with regard to the actuating projection.

7. The apparatus according to claim 1, wherein a rotatable, axially-fixed rotary clamping sleeve is arranged in the locking housing, wherein the rotatable, axially-fixed rotary clamping sleeve is operatively coupled in a torque-resistant manner to the actuating projection and has a second guide slot, wherein a second pin, which extends in the locking shaft, engages in the second guide slot, so that during rotation of the rotatable, axially-fixed rotary clamping sleeve the locking shaft can be is axially displaced.

8. The apparatus according to claim 5, and further including a rotatable, axially-fixed rotary clamping sleeve within the locking housing, wherein the rotatable, axially-fixed rotary clamping sleeve is operatively coupled in a torque resistant manner to the actuating projection and has a second guide slot wherein a second pin extends in the locking shaft and engages in the second guide slot such that during rotation of the rotable, axially-fixed rotary clamping sleeve the locking shaft is axially displaced, wherein the actuating projection comprising the securing element is arranged in a torque-resistant manner with regard to a protrusion of the rotatable, axially-fixed rotary clamping sleeve and wherein the actuating projection is enabled to be linearly displaced against a spring arranged between the actuating projection and the rotatable, axially-fixed rotary clamping sleeve.

9. The apparatus according to claim 6, and further including, a rotatable, axially-fixed rotary clamping sleeve within the locking housing, wherein the rotatable, axially-fixed rotary clamping sleeve is operatively coupled in a torque resistant manner to the actuating projection and has a second guide slot wherein a second pin extends in the locking shaft and engages in the second guide slot such that during rotation of the rotatable, axially-fixed rotary clamping sleeve the locking shaft is axially displaced, wherein the actuating projection is formed in one piece on the rotatable, axially-fixed rotary clamping sleeve.

10. Apparatus comprising a compression latch including a cylindrical housing wherein the cylindrical housing includes a first housing axial end opening, and a second housing axial end opening, a locking shaft, wherein the locking shaft is rotatably and axially movable within the cylindrical housing, wherein the locking shaft includes a first shaft axial end and a second shaft axial end, wherein the second shaft axial end is configured to engage an axial and rotatably movable locking tongue at the second housing axial end opening, a cylindrical sleeve, wherein the cylindrical sleeve is rotatably movable in a fixed axial position within the cylindrical housing, wherein the cylindrical sleeve includes an axially tapered annular sleeve slot, wherein the axially tapered annular sleeve slot is bounded by a slot end, a shaft engagement pin, wherein the shaft engagement pin is in fixed operative engagement with the locking shaft and is in movable engagement within the axially tapered annular sleeve slot, a cylindrical securing element, wherein the cylindrical securing element is in rotatable and axially movably mounted relation in the cylindrical housing, is in operative connection with an actuating projection, wherein the actuating projection is accessibly rotatable by tool engagement through the first housing axial end opening, is in rotatably engaged connection and is axially movable relative to the cylindrical sleeve, includes a circumferentially extending guiding recess, a latching recess, wherein the latching recess, extends in the circumferentially-fixed rotary guiding recess, and extends transversely from the circumferentially-fixed rotary guiding recess and toward the second housing axial end opening, a securing element engaging pin, wherein the securing element engaging pin is in fixed inward extending relation with the cylindrical housing, extends in the circumferentially-fixed rotary guiding recess, wherein the cylindrical securing element is rotatable within the cylindrical housing with the securing element engaging pin in the circumferentially-fixed rotary guiding recess, is releasably engageable in the latching recess, a spring, wherein the spring is operative to bias the cylindrical securing element axially toward the first housing axial end opening, bias the latching recess to engage the securing element engaging pin, wherein with the securing element engaging pin engaged in the latching recess, the spring biases the securing element so that the latching recess is in biased engagement with the securing element engaging pin and rotation of the cylindrical securing element and the locking shaft is prevented, wherein the securing element engaging pin and the latching recess are disengageable through tool engagement with the actuating projection to move the cylindrical securing element axially inward relative to the first housing axial end opening and rotationally, such that the cylindrical securing element and the cylindrical sleeve are rotatable within the cylindrical housing, whereby rotation of the cylindrical sleeve is operative to cause axial movement of the locking shaft in the second housing axial end opening without rotation until the shaft engagement pin engages the slot end, and thereafter the locking shaft rotates with rotation of the actuating projection.

11. The apparatus according to claim 10 wherein the cylindrical sleeve includes an axially extending sleeve projection, wherein the cylindrical securing element is axially movable relative to the axially extending sleeve projection while in rotatably engaged relation with the axially extending sleeve projection.

12. The apparatus according to claim 10 wherein the actuating projection extends on a first axial side of the cylindrical securing element.

13. The apparatus according to claim 10 and further comprising a further spring, wherein the further spring acts to bias the locking shaft axially toward the second housing axial end opening.

14. The apparatus according to claim 10 wherein the cylindrical housing is axially elongated such that the cylindrical housing is configured to extend through an aperture in a door.

15. The apparatus according to claim 10 wherein the second shaft axial end of the locking shaft is configured to axially receive a screw therein, wherein the screw is configured to hold the axial and rotatably moveable locking tongue in engagement with the locking shaft.

16. The apparatus according to claim 10 wherein the securing element engaging pin extends inwardly through an opening in an outside surface of the cylindrical housing.

17. The apparatus according to claim 10 wherein the locking shaft includes an outward extending projection, wherein the outward extending projection is configured to engage a stop in operative connection with the cylindrical housing, wherein engagement of the outward extension projection and the stop is operative to prevent rotation of the locking shaft within the cylindrical housing until the locking shaft moves axially toward the second housing axial end opening and the shaft engagement pin engages the slot end.

18. The apparatus according to claim 10 and further comprising a nut, wherein the nut is releasibly engageable with the cylindrical housing at an axial end opposed of the first housing axial end opening.

19. The apparatus according to claim 10 wherein the securing element engaging pin engages the latching recess in a rotational position in which the locking shaft is disposed axially within the cylindrical housing closer to the first housing axial end opening than the fixed axial position of the locking shaft when the shaft engagement pin is in engagement with the slot end.

20. The apparatus according to claim 10 wherein the locking shaft extends axially within the cylindrical sleeve, and wherein the shaft engagement pin extends outward from the locking shaft and to within the axially tapered annular sleeve slot.

* * * * *